US007811673B2

(12) United States Patent
Sakamoto et al.

(10) Patent No.: US 7,811,673 B2
(45) Date of Patent: Oct. 12, 2010

(54) HIGH STRENGTH POLYETHYLENE FIBER

(75) Inventors: Godo Sakamoto, Otsu (JP); Tooru Kitagawa, Otsu (JP); Yasuo Ohta, Otsu (JP); Yasunori Fukushima, Otsu (JP); Hiroki Murase, Otsu (JP)

(73) Assignee: Toyo Boseki Kabushiki Kaisha, Osaka-Shi (JP)

( * ) Notice: Subject to any disclaimer, the term of this patent is extended or adjusted under 35 U.S.C. 154(b) by 478 days.

(21) Appl. No.: 10/582,624

(22) PCT Filed: Mar. 12, 2004

(86) PCT No.: PCT/JP2004/018004

§ 371 (c)(1),
(2), (4) Date: Jun. 12, 2006

(87) PCT Pub. No.: WO2005/056892

PCT Pub. Date: Jun. 23, 2005

(65) Prior Publication Data

US 2007/0148452 A1 Jun. 28, 2007

(30) Foreign Application Priority Data

| | | |
|---|---|---|
| Dec. 12, 2003 | (JP) | 2003-414574 |
| Jan. 9, 2004 | (JP) | 2004-003564 |
| Mar. 26, 2004 | (JP) | 2004-092305 |
| Jul. 8, 2004 | (JP) | 2004-201430 |

(51) Int. Cl.
*D01F 6/00* (2006.01)

(52) U.S. Cl. ..... 428/634; 428/394

(58) Field of Classification Search ..... None
See application file for complete search history.

(56) References Cited

U.S. PATENT DOCUMENTS

| | | | | |
|---|---|---|---|---|
| 5,342,567 | A | 8/1994 | Chen et al. | |
| 6,605,348 | B1 | 8/2003 | Ohta et al. | |
| 6,969,553 | B1 * | 11/2005 | Tam et al. | 428/364 |
| 7,078,097 | B1 * | 7/2006 | Tam et al. | 428/364 |
| 7,078,099 | B1 * | 7/2006 | Tam et al. | 428/394 |
| 7,081,297 | B2 * | 7/2006 | Tam et al. | 428/357 |
| 7,115,318 | B2 * | 10/2006 | Tam et al. | 428/357 |

FOREIGN PATENT DOCUMENTS

| | | | | |
|---|---|---|---|---|
| CA | 1152272 | | | 8/1983 |
| EP | 1193335 | A1 | | 4/2002 |
| JP | 60-47922 | | | 10/1985 |
| JP | 64-8732 | | | 2/1989 |
| JP | 3-137215 | | | 6/1991 |
| JP | 7-3524 | | | 1/1995 |
| JP | 7-501859 | | | 2/1995 |
| JP | 11-350247 | A | | 12/1999 |
| JP | 2000-265319 | A | | 9/2000 |
| JP | 2001-73224 | | | 3/2001 |
| JP | 2001-303358 | A | | 10/2001 |
| JP | 2003-64525 | A | * | 3/2003 |
| JP | 2006342463 | A | * | 12/2006 |
| JP | 2006342464 | A | * | 12/2006 |
| WO | WO 93/12276 | | | 6/1993 |
| WO | WO 01/12885 | A1 | | 2/2001 |
| WO | 0173173 | | | 10/2001 |

OTHER PUBLICATIONS

JP2003-64525 machine translation, Mar. 2003.*
W.F. Wong, et al., "Analysis of the deformation of gel-spun polyethylene fibres using Raman spectroscopy," *Journal of Materials Science*, vol. 29, pp. 510-519, 1994.
Robert S. Bretzlaff, et al., "Frequency Shifting and Asymmetry in Infrared Bands of Stressed Polymers," *Macromolecules*, vol. 16, pp. 1907-1917, 1983.
E . Bright Wilson, Jr., et al., *Molecular Vibrations*, Ch. 4, pp. 54-76, Dover Publications, 1980.
Supplementary European Search Report from EP 04820163.6 dated Nov. 7, 2007.

* cited by examiner

*Primary Examiner*—Jill Gray
(74) *Attorney, Agent, or Firm*—Kenyon & Kenyon LLP

(57) ABSTRACT

To provide a novel high strength polyethylene multifilament which consists of a plurality of filaments having high strengths and uniform internal structures, and showing a narrow variation in the strengths of the monofilaments, and which has been difficult to be provided by the conventional gel spinning method.

A high strength polyethylene multifilament consisting of a plurality of filaments which are characterized in that the crystal size of monoclinic crystal is 9 nm or less; the stress Raman shift factor is $-5.0\ cm^{-1}/(cN/dTex)$ or more; the average strength is 20 CN/dTex or higher; the knot strength retention of each monofilament is 40% or higher; CV indicating a variation in the strengths of the monofilaments is 25% or lower; the elongation at break is from 2.5% inclusive to 6.0% inclusive; the fineness of each filament is 10 dTex or less; and the melting point of the filaments is 145° C. or higher.

7 Claims, No Drawings

HIGH STRENGTH POLYETHYLENE FIBER

This is a 371 national phase application of PCT/JP2004/018004 filed 3 Dec. 2004, claiming priority to Japanese Applications No. 2003-414574 filed 12 Dec. 2003, No. 2004-003564 filed 9 Jan. 2004, No. 2004-092305 filed 26 Mar. 2004, and No. 2004-201430 filed 8 Jul. 2004, the contents of which are incorporated herein by reference.

TECHNICAL FIELD

The present invention relates to novel high strength polyethylene multifilaments applicable to a wide range of industrial fields such as high performance textiles for sportswears and safety outfits (e.g., bulletproof/protective clothing, protective grooves, etc.), rope products (e.g., tugboat ropes, mooring ropes, yacht ropes, ropes for constructions, etc.), braided products (e.g., fishing lines, blind cables, etc.), net products (e.g., fisheries nets, ball-protective nets, etc.), reinforcing materials or non-woven cloths for chemical filters, buttery separators, etc., canvas for tents, etc., and reinforcing fibers for composites which are used in sports goods (e.g., helmets, skis, etc.), speaker cones, prepregs and reinforcement of concrete.

BACKGROUND OF THE INVENTION

High strength polyethylene multifilaments obtained by so-called "gel spinning method" using ultra-high molecular weight polyethylenes as raw materials are known to have such high strength and high elastic modulus that any of the prior art has never achieved, and such high strength polyethylene multifilaments have already been widely used in various industrial fields (cf. Patent Literature 1 and Patent Literature 2).

Patent Literature 1: JP-B-60-47922 (1985)

Patent Literature 2: JP-B-64-8732 (1989)

High strength polyethylene multifilaments recently have come into wide use in not only the above fields but also other fields, and are earnestly demanded to have more uniform, higher strength and higher elastic modulus relative to required performance.

DISCLOSURE OF THE INVENTION

Problems to be Solved by the Invention

One of effective means to satisfy the above wide range of demands is to decrease the interior defects of multifilaments as mush as possible, and further, filaments constituting a multifilament are required to be uniform. The conventional gel spinning method has been hard to suppress the internal defective structures of filaments to sufficiently low levels, and the filaments constituting such a multifilament have wide variation in the strengths thereof. The present inventors have inferred the causes for these disadvantages as follows.

A super drawing operation becomes possible by employing the conventional gel spinning method, so that the resultant multifilament can have high strength and high elastic modulus, with the result that the filaments constituting the multifilament are so highly crystallized and ordered in their structures that the long periodic structures thereof can not be observed in the measurement of small-angle X-ray scattering. However, in the meantime, defective structures which can not be eliminated anyhow are formed in the filaments, as will be described later. The agglomeration of such defective structures induces a wide stress distribution inside the filaments when a stress is applied to the filaments. The skin-core structures of the filaments are considered as one of these defective structures.

The present inventors have discovered that it is the most important to suppress the sizes of monoclinic crystals to a lower level, in order to improve the knot strength of filaments. Although the reasons therefor can not be clearly described, it is confirmed from the X-ray diffraction of the resultant polyethylene filaments, that diffraction spots derived from the orthorhombic crystals are mainly observed, and also that some peaks derived from monoclinic crystals can be observed. As a result of the investigation, it is found to be important to inhibit the growth of the sizes of monoclinic crystals below a certain level. The reasons therefor are roughly understood as follows, although can not be precisely described. The inventors have found that, when filament-like solutions in a state of xerogel from which a solvent has been removed are drawn long, monoclinic crystals tend to grow relatively larger in size, since the molecules of the solvent which inhibit the growth of the monoclinic crystals are a few in amount. When such monoclinic crystals have grown up to a size exceeding a certain limit, stresses tend to concentrate between the monoclinic crystals and the orthorhombic crystals in a filament, when the filament is distorted, and this concentration becomes a starting point for destruction of the filament. Consequently, this is undesirable in view of knot strength.

Next, the inventors have found a correlation among each of the knot strength, the sizes of fine crystals constituting a filament, the orientation of such crystals and a variation in the above structural parameters found at some sites of the filament. In order to improve the knot strength of a filament, it is microscopically and macroscopically ideal that the filament can be flexibly and arbitrarily bent. In this regard, it is needed to inhibit the possibility to destruct the fine structure of a filament due to the bending, as much as possible. It is needed that the orientation and the size of the crystals in the filament should be as high as possible and as large as possible, respectively. However, too large crystals and too high crystal orientation induce too high contrast with the residual amorphous regions in the filament. This matter, on the contrary, lowers the knot strength of the filament. The inventors further have found it to be important that the crystal sizes and orientations at the respective sites of the filament should be substantially in the same degrees. This is because the structural non-uniformity in the respective sites of the fine structure of the filament, particularly the structural non-uniformity in the crystal size and orientation of the crystals in the adjacent sites of the filament, permits stresses to concentrate on such non-uniformity site as a starting point, when the filament is distorted, which leads to poor knot strength.

A stress distribution which occurs in the structure of a filament can be measured, for example, by the Raman scattering method as indicated by Young et al (Journal of Materials Science, 29, 510 (1994)). The Raman band, that is, a normal vibration position, is determined by solving an equation which consists of the constant of the force of the molecular chains composing the filament, and the configuration of the molecule (the internal coordinates) (Molecular Vibrations by E. B. Wilson, J. C. Decius and P. C. Cross, Dover Publications (1980)). For example, this phenomenon has been theoretically described by Wools et al as follows: the molecules of the filament distort together with the distortion of the filament, so that, consequently, the normal vibration position changes (Macromolecules, 16, 1907 (1983)). When a structural non-uniformity such as agglomeration of defects is present in the filament, stresses induced upon distorting the filament from an external are different depending on the sites of the filament. This change can be detected as a change in the band profile. Therefore, the investigation of a relationship between the strength of the filament and a change in the Raman band profile, found when a stress is applied to the filament, makes it possible to quantitatively determine a stress distribution induced in the filament. In other words, as will be described later, a filament small in structural non-uniformity tends to take a value within a region including a Raman shift factor. A high strength polyethylene filament obtained by the disclosed "gel spinning method" has a very high tensile strength because of its highly oriented structure, but is easily broken by a relatively low stress, as well as the knot strength thereof, when the filament is bent. When the filament further has a non-uniform structure in its sectional direction, like a skin-core structure, the filament is more easily broken, if it is in a bent state. As a result of the inventors' intensive studies, it is found that a filament small in structural non-uniformity is strong against a tensile state while it is being bent. In other words, in a filament small in structural non-uniformity, the ratio of the knot strength to the tensile strength becomes higher.

Therefore, one of the defects of the high strength polyethylene multifilaments obtained by the disclosed "gel spinning method" is that filaments spun from nozzle holes have variable strengths depending on their conditions after the spinning, in comparison with filaments obtained by the usual melt-spinning method or the like. Therefore, there is a problem in that a multifilament consisting of such filaments contains a filament whose strength is markedly lower, from the viewpoint of the average fineness of the multifilament. When the multifilament includes such a filament having a strength lower than the average strength, the following disadvantage is caused. For example, when such multifilaments are used for a fishing line, a rope, a bulletproof/protective clothing or the like whose textiles are subject to abrasion, and if such textiles are made of filaments having variable thickness, stresses tend to concentrate on a thinner portion of such a product, so that this product ruptures. Also in the manufacturing steps for such a product, troubles due to the cutting of the filaments are likely to occur, which gives an adverse influence on the productivity. The present invention is therefore intended to provide a high strength polyethylene multifilament consisting of a plurality of filaments which are excellent in uniformity and have a narrow variation in the strengths of the monofilaments, by improving the foregoing problems.

The present inventors have intensively studied and succeeded in the development of a novel high strength polyethylene multifilament with an uniform internal structure, which consists of a plurality of filaments having a narrow variation in the strengths thereof. These characteristics have been hard for the conventional gel spinning method to provide. Thus, the present invention is accomplished as the result of the above development.

Means for Solving the Problems

The present invention provides the following.

1. A high strength polyethylene multifilament, wherein said multifilament has a crystal size of monoclinic crystal of not larger than 9 nm.

2. The high strength polyethylene multifilament, wherein said multifilament has a ratio of the crystal sizes derived from the (200) and (020) diffractions of an orthorhombic crystal of from 0.8 inclusive to 1.2 inclusive.

3. The high strength polyethylene multifilament according to claim 1, wherein said multifilament has a stress Raman shift factor of not smaller than $-5.0\ cm^{-1}/(cN/dTex)$.

4. The high strength polyethylene multifilament, wherein said multifilament has an average strength of not lower than 20 cN/dTex.

5. The high strength polyethylene multifilament, wherein a knot strength retention of monofilaments constituting the high strength multifilament is not lower than 40%.

6. The high strength polyethylene multifilament, wherein CV which indicates a variation in the strengths of monofilaments constituting the high strength multifilament is not higher than 25%.

7. The high strength polyethylene multifilament, wherein said multifilament has an elongation at break of from 2.5% inclusive to 6.0% inclusive.

8. The high strength polyethylene multifilament, wherein each of filaments constituting the multifilament has a fineness of not higher than 10 dTex.

9. The high strength polyethylene multifilament, wherein the melting point of filaments is not lower than 145° C.

Effect of the Invention

The present invention makes it possible to provide an uniform and high strength polyethylene multifilament consisting of a plurality of filaments which have each as few internal defects as possible that the conventional gel spinning method can not achieve to such a sufficiently low level, and which have a narrow variation in the strengths thereof.

BEST MODES FOR CARRYING OUT THE INVENTION

Hereinafter, the present invention will be described in more detail.

A novel method is needed to obtain a textile fiber according to the present invention, and the following method is recommended as an example of such a method, which should not be construed as limiting the scope of the present invention in any way. It is needed that a high molecular weight polyethylene, as a raw material for the textile fiber of the present invention, has a limiting viscosity [η] of not smaller than 5, preferably not smaller than 8, still more preferably not smaller than 10. When the limiting viscosity is smaller than 5, the resultant high strength textile fiber can not have a desired strength exceeding 20 cN/dtex.

An ultra-high molecular weight polyethylene to be used in the present invention has repeating units of substantially ethylene. The ultra-high molecular weight polyethylene may be a copolymer of ethylene with a small amount of other monomer such as α-olefin, acrylic acid or its derivative, methacrylic acid or its derivative, vinylsilane or its derivative, or the like; or the ultra-high molecular weight polyethylene may be a blend of some of these copolymers, a blend of such a copolymer with an ethylene homopolymer or a blend of such a copolymer with a homopolymer of α-olefin or the like. Particularly, the use of a copolymer of ethylene with α-olefin such as propylene, butene-1 or the like is preferable, since short or long chain branches are contained in a spinning solution to a certain degree by using such a copolymer, which is desirable for the manufacturing of the textile fiber of the present invention, particularly for stable spinning and drawing. However, a too large content of a component other than ethylene makes it hard to draw filaments. Therefore, the content of other component is not larger than 0.2 mol %, preferably not larger than 0.1 mol % in monomer unit, so as to obtain filaments having high strength and high elastic modulus. Of course, the polyethylene may be a homopolymer of ethylene monomers.

As a recommended method of the present invention, such a high molecular weight polyethylene is dissolved in a volatile organic solvent such as decalin, tetralin or the like. The use of a solvent which is solid or non-volatile at a room temperature is undesirable-since the spinning efficiency becomes very poor. This is described below. When a volatile solvent is used, the volatile solvent present on the surface of a gel-like filament injected from a spinneret in the early stage of the spinning step slightly evaporates. Although not definitely confirmed, the cooling effect attributed to the latent heat in association with the evaporation of the solvent is considered to stabilize the spun filament. The concentration of the ultra-high molecular weight polyethylene is preferably not higher than 30 wt. %, more preferably not higher than 20 wt. %. An optimal concentration is selected according to the limiting viscosity [η] of the ultra-high molecular weight polyethylene as the raw material. In the spinning step, preferably, the temperature of the spinneret is set at a temperature 30° C. higher than the melting point of the polyethylene and lower than the boiling point of the solvent. This is because the viscosity of the polymer is too high at temperatures close the melting point of the polyethylene, with the result that the resulting filaments can not be quickly pulled up. On the other hand, when the temperature of the spinneret is higher than the boiling point of the solvent, the solvent boils immediately after the injection from the spinneret, with the result that the resulting filaments frequently break just below the spinneret.

Herein, the important factors for the method for obtaining uniform filaments according to the present invention will be described. One of such factors is that a previously rectified inert gas of high temperature is individually fed to each of injected solutions from the orifices of a nozzle. The velocity of the inert gas is preferably not higher than 1 m/second. When the velocity of the inert gas is higher than 1 m/second, the evaporation rate of the solvent becomes higher, so that a non-uniform structure tends to form along the sectional direction of the resulting filament, and what is worse, the filament may break. The temperature of the inert gas is preferably within a range of ±10° C. of the nozzle temperature, more preferably ±5° C. thereof. The individual feeding of the inert gas to each of the injected filament-like solutions makes it possible to uniform the cooling conditions for the filament-like solutions, so that non-drawn filaments having uniform structures can be obtained. Desired uniform and high strength polyethylene filaments can be obtained by evenly drawing the above non-drawn filaments having the uniform structures.

Another factor is that the injected gel-like filaments from the spinneret are rapidly and uniformly cooled, while careful attentions being paid to a difference in speed between the cooling medium and the gel-like filaments. The cooling speed is preferably not lower than 1,000° C./second, more preferably not lower than 3,000° C./second. As for this speed difference, the integrated value of speed differences, i.e., the accumulated speed difference is preferably not larger than 30 m/minute, more preferably not larger than 15 m/minute. Under the foregoing conditions, non-drawn filaments excellent in uniformity can be obtained. In this regard, the accumulated speed difference is calculated by the following equation:

$$\text{Accumulated speed difference}=\int(\text{the speed of the filament-like solution}-\text{the speed of the cooling medium in the filament-pulling direction}).$$

The gel-like filaments are rapidly and uniformly cooled to thereby obtain non-drawn filaments having uniform structures in the sectional directions. When the cooling speed for the injected gel-like filaments is lower, the internal structures of the resultant filaments become non-uniform. Herein, description is made on a multifilament as an example. When the cooling conditions to the respective filaments constituting a multifilament differ, non-uniformity among each of the filaments is accelerated. When the speed difference between the pulled filaments and the cooling medium is large, a frictional force acts between the pulled filaments and the cooling medium, which makes it hard to pull the filaments at a sufficient spinning speed.

To obtain an appropriate cooling speed, it is recommended to use a liquid having a large coefficient of heat-transfer as the cooling medium. Above all, the use of a liquid incompatible with a solvent to be used is preferable. For example, water is preferably used for its availability.

To reduce the accumulated speed difference, the following method is considered to be effective, although it does not limit the scope of the present invention in any way. For example, a funnel is attached at the center of a cylindrical bath so as to allow a liquid and gel-like filaments to simultaneously flow to thereby pull up them together; or the gel-like filaments are allowed to flow along a liquid which drops like waterfall to thereby simultaneously pull them together. By employing any of these methods, the accumulated speed difference can be reduced, in comparison with that found when gel-like filaments are cooled using an unmoved liquid.

The resulting non-drawn filaments are heated and drawn to be several times longer, while removing the solvent. As the case may be, the non-drawn filaments are drawn in multistage so as to obtain high strength polyethylene filaments having highly uniform internal structures as described above. In this regard, the deforming speed of the filament while being drawn is taken as an important parameter. When the deforming speed of the filament is too high, undesirably, the filament breaks before a sufficient multiplying factor for the drawing is achieved. When this deforming speed is too low, the molecular chains in the filament relaxes while the filament being drawn. As a result, the filament becomes thinner and longer by the drawing, however, has poor physical properties. The deforming speed of the filament is preferably from 0.005 $s^{-1}$ to 0.5 $s^{-1}$, more preferably from 0.01 $s^{-1}$ to 0.1 $s^{-1}$. The deforming speed of the filament can be calculated from the multiplying factor for drawing the filament, the drawing speed and the length of the heating section of an oven. That is, the deforming speed can be determined by the equation:

$$\text{Deforming speed}(s^{-1})=(1-1/\text{a multiplying factor})\times\text{a drawing speed/the length of a heating section}$$

To obtain a filament having a desired strength, the multiplying factor for drawing is not smaller than 10, preferably not smaller than 12, still more preferably not smaller than 15.

The crystal size of monoclinic crystal is preferably not larger than 9 nm, more preferably not larger than 8 nm, particularly not larger than 7 nm. When this crystal size is larger than 9 nm, stresses tend to concentrate between the monoclinic fine crystals and the orthorhombic fine crystals in a filament, upon distorting the filament, and the filament may start to break from such a concentration point.

The ratio of the crystal sizes derived from the (200) and (020) diffractions of the orthorhombic crystal is preferably from 0.8 to 1.2, more preferably from 0.85 to 1.15, particularly from 0.9 to 1.1. When this crystal size ratio is smaller than 0.8 or when it is larger than 1.2, the crystals tend to grow selectively in one axial direction, when the configurations of the crystals are considered. As a result, the fine crystals present around such selectively grown crystals collide with one another, upon distorting the filament. Thus, undesirably, stresses concentrate on such collision, and the structure of the filament is broken.

The stress Raman shift factor is preferably not smaller than $-5.0\ cm^{-1}/(cN/dTex)$, more preferably not smaller than $-4.5\ cm^{-1}/(cN/dTex)$, particularly not smaller than $-4.0\ cm^{-}/(cN/dTex)$. When the stress Raman shift factor is smaller than $-5.0\ cm^{-1}/(cN/dTex)$, undesirably, there may arise a possible stress distribution due to the concentration of stresses.

The average strength of the filament is preferably not smaller than 20 cN/dTex, more preferably not smaller than 22 cN/dTex, particularly not smaller than 24 cN/dTex. When the average strength of the filament is smaller than 20 cN/dTex, a product made using such filaments may be insufficient in strength.

The retention of the knot strength of each of the filaments constituting the high strength polyethylene multifilament is preferably not lower than 40%, more preferably not lower than 43%, particularly not lower than 45%. When the retention of the knot strength of the filaments is lower than 40%, multifilaments of such filaments may be damaged while a product is being made using the multifilaments.

The CV which indicates a variation in the strengths of the monofilaments constituting the high strength polyethylene multifilament is preferably not higher than 25%, more preferably not higher than 23%, particularly not higher than 21%. When the CV is higher than 25%, a product made using such multifilaments shows a variation in the strength.

The elongation at break is preferably from 2.5% to 6.0%, more preferably from 3.0% to 5.5%, particularly from 3.5% to 5.0%. When the elongation at break is lower than 2.5%, the filaments are cut in the course of manufacturing the multifilament, which leads to a poor operation efficiency. When the elongation at break exceeds 6.0%, a product made using such multifilaments is given a non-ignorable influence of permanent deformation.

The fineness of the filaments is preferably not larger than 10 dTex, more preferably not larger than 8 dTex, particularly not larger than 6 dTex. When the fineness of the filaments is larger than 10 dTex, it becomes difficult to improve the performance of the multifilament up to the initial mechanical properties in the course of manufacturing the same.

The melting point of the filaments is preferably not lower than 145° C., more preferably not lower than 148° C. When the melting point of the filaments is not lower than 145° C., the filaments can withstand a higher temperature in a step which requires heating, and this is preferable in view of saving of the treatment.

The high strength polyethylene multifilament of the present invention has high strength and high elastic modulus, and have an uniform internal structure, showing narrow variation in performance, without any possibility to have local weak portions. Therefore, the high strength polyethylene multifilament of the present invention can be applied to high performance textiles for sportswears and safety outfits such as bulletproof/protective clothing and protective grooves. The bulletproof/protective clothing is made using the novel high strength polyethylene multifilaments of the present invention as a raw material, which may be blended with other known fibers. The bulletproof/protective clothing is made of a fabric woven from the above multifilaments, or a laminated sheet of a plurality of sheet-like materials each of which has thereon the multifilaments arrayed along one direction and impregnated with a resin, and each of which is laminated on another with the multifilaments orthogonal to each other. The protective grooves are made of the novel high strength polyethylene multifilaments of the present invention, which may be blended with other known fibers according to its design and function. To impart functionality to the grooves, the above multifilaments may be blended with cotton fibers or the like having a moisture absorbing property so as to absorb sweat, or may be blended with highly extensible urethane fibers to improve the fitting comfortablility. The multifilaments may be mixed with colored yarns to provide colored grooves, so that it makes hard to distinguish the stains thereof, or that the fashionabililty of the grooves is improved. As a method of blending the high strength polyethylene multifilaments with other fibers, an interlacing process by means of air confounding or a Taslan processing is employed. Other than those, the filaments are opened by the application of a voltage, and the opened filaments are blended with other fibers. Otherwise, the filaments are simply twisted or braided, or are covered. When the filaments are used as staples, the filaments may be blended with other fibers in the course of spinning; or the spun and finished filaments may be blended with other fibers by any of the above blending methods.

The high strength polyethylene multifilaments of the present invention can be applied to ropes such as tugboat ropes, mooring ropes, yacht ropes and ropes for constructions, fishing lines, braided products such as blind cables, and net products such as fisheries nets and ball-protective nets. The polyethylene multifilament of the present invention has high strength and high elastic modulus, and have an uniform internal structure, showing a narrow variation in performance, so that the multifilament has no possibility to have local weak portion. Therefore, the multifilament of the present invention can be used for ropes and fishing lines which are required to have high strength as a whole.

The ropes are manufactured from the above novel high strength polyethylene multifilaments of the present invention, which may be blended with other known fibers. The ropes may be coated with other material such as a low molecular weight polyolefin or a urethane resin according to its design or function. The ropes may have twisted structures such as three-twisted ropes and six-twisted ropes, braided structures such as eight-twisted ropes and twelve-twisted ropes, or double-braided structures (in which a core portion is spirally coated at its outer periphery with yarns, strands or the like). An ideal rope can be designed according to the end use and performance. The ropes of the present invention show less deterioration in performance, attributed to moisture absorption or water absorption. Further, the ropes of the present invention have high strength despite the small diameters thereof, arising no kink, and are easy to store. Thus, the ropes of the present invention are suitable for use in a variety of industrial fields or a variety of civil uses, such as fisheries ropes, tugboat ropes, mooring ropes, hawsers, yacht ropes, mountaineering ropes, agricultural ropes, and ropes for use in civil works, constructions, electrical equipment, the works for constructions, etc. Particularly, the ropes of the present invention are especially suitable for use in vessels and marine products in relation to the fisheries. The nets are manufactured from the above novel high strength polyethylene multifilaments of the present invention, which may be blended with other known fibers. Otherwise, the nets made of the high strength polyethylene multifilaments may be coated with other material such as a low molecular weight polyolefin or an urethane resin in accordance with its design or function. The nets may be of knotted or non-knotted type or of Raschel structure. An ideal net can be designed in accordance with its end use and function. The nets of the present invention are strong in their net textures and are superior in anti-bending fatigue and abrasion proof, and therefore are suitably used in various industrial fields and civil uses, such as fisheries nets (e.g., trawl warps, fixed nets, gauze nets and gill nets); agricultural nets (e.g., animal- or bird-proofing nets); sports nets (e.g., golf nets and ball-protective nets); safety nets; and nets for use in civil engineering works, electric equipment and works for constructions.

The high strength polyethylene multifilament of the present invention is superior in chemical resistance, light proof and weather resistance, and thus are applicable to reinforcing materials or non-woven cloths for chemical filters and battery separators. Further, high strength polyethylene cut fibers can be obtained from the novel high strength polyethylene multifilaments of the present invention. The polyethylene filaments of the present invention have high strength and high elastic modulus, and have uniform internal structures, thus showing a narrow variation in performance. Because of their high uniformity, non-woven cloths made thereof by the wet method are hard to have suction spots thereon when moisture is sucked from the non-woven cloths under reduced pressure, since a variation in suction hardly occurs. Such spots, when formed, degrade the strength and piercing resistance of the non-woven cloths. The fineness of a single cut fiber is not particularly limited, and it is usually 0.1 to 20 dpf. The fineness of a single cut fiber may be appropriately selected according to an end use: for example, the cut fibers whose single fiber fineness is large are used as reinforcing fibers for concrete and cement or ordinary non-woven cloths, and the cut fibers whose single fiber fineness is small are used for high density non-woven cloths for chemical filters and battery separators. The length of the cut fibers is preferably not longer than 70 mm, more preferably not longer than 50 mm. Too long cut fibers are apt to tangle with one another and are hard to be dispersed uniformly. The means for cutting the multifilament is not limited, and for example, a Guillotine cutter or a rotary cutter is used.

The high strength polyethylene multifilament of the present invention can be applied to sports goods such as canvas for tents or the like, helmets and skis, speaker cones, and reinforcing fibers for composites for reinforcing prepreg and concrete. The fiber-reinforced concrete products of the present invention can be obtained by using the foregoing novel high strength polyethylene multifilament of the present invention as reinforcing fibers, because the polyethylene multifilament has high strength and high elastic modulus, having a uniform internal structure, showing a narrow variation in performance, and thus has no possibility to have local weak portion therein. As a result, the multifilament of the present invention is improved in uniformity in strength, compression strength, flexural strength and toughness as a whole, and thus is excellent in impact resistance and durability. When in use as reinforcing fibers for canvas for tents, sports goods such as helmets and skis, speaker cones or prepregs, high strength products can be provided, since such reinforcing fibers are highly uniform and thus have no local weak portion therein.

Hereinafter, the methods and conditions for measuring the characteristics of the multifilament of the present invention are described.

(Strength, Elongation Percentage and Elastic Modulus of Multifilament)

The strength and elastic modulus of the multifilament of the present invention were measured as follows, using "Tensilon" (ORIENTECH): a sample with a length of 200 mm (i.e., the length between chucks) out of the multifilament was extended at an elongation rate of 100%/minute under an atmosphere of 20° C. and a relative humidity of 65% so as to take a deformation-stress curve. The strength (cN/dTex) and the elongation percentage (%) were calculated from a stress and an elongation at the breaking point, and the elastic modulus (cN/dTex) was calculated from a tangent which formed the highest gradient at and around the origin of the curve. Each of the values was an average of the found values obtained from 10 measurements.

(Strength of Monofilament) The strength and elastic modulus of a monofilament were measured using samples which are 10 monofilaments arbitrarily selected from one multifilament. In case of a multifilament comprising less than 10 monofilaments, all the monofilaments were used as objects to be measured.

Out of each monofilament with a length of about 2 m, one meter thereof was cut and weighed, and the weight was converted in terms of 10,000 m to measure the fineness (dTex). In this regard, the length of this monofilament (1 m) was measured under a load of about one tenth of the load used for the measurement of the fineness, to thereby obtain a sample with a constant length. The rest of this monofilament was used to measure the strength thereof by the same method as above. CV was calculated by the following equation:

$CV$=a standard deviation of the strength of a monofilament/an average of the strengths of monofilaments×100

(Knot Strength Retention of Monofilament)

The strength and elastic modulus of a monofilament were measured using samples which are 10 monofilaments arbitrarily selected from one multifilament. In case of a multifilament comprising less than 10 monofilaments, all the monofilaments were used as objects to be measured.

Out of each monofilament with a length of about 2 m, one meter thereof was cut and weighed, and the weight was converted in terms of 10,000 m to measure the fineness (dTex). In this regard, the length of this monofilament (1 m) was measured under a load of about one tenth of the load used for the measurement of the fineness, to thereby obtain a sample with a constant length. The rest of this monofilament was knotted at its center to make a knot, and was then subjected to a tensile test in the same method as in the measurement of the strength of the monofilament. In this regard, the knot was made according to the method shown in FIG. 3 described in JIS L1013, and the direction of knotting was always the same as the direction b shown in FIG. 3.

Knot strength retention=an average of the knot strengths of the monofilaments/an average of the strengths of the monofilaments×100

(Limiting Viscosity)

The specific viscosities of variously diluted solutions of decalin of 135° C. were measured with a Ubbelohde type capillary viscometer, and the resultant viscosities were plotted relative to the concentrations of decalin in the solutions. Then, the limiting viscosity was determined from an extrapolation point to the origin of a linear line obtained by the approximation of the least squares of the plots. In this measurement, a sample was divided or cut into pieces with lengths of about 5 mm, and the cut pieces were dissolved while stirring, admixed with 1 wt. % based on the weight of the polymer of an antioxidant ("Yoshinox" manufactured by Yoshitomi Seiyaku) at 135° C. for 4 hours, to thereby prepare a measuring solution.

(Measurement with Differential Scanning Calorimeter)

A differential scanning calorimeter DSC 7 manufactured by PerkinElmer was used. A sample was cut into pieces with lengths of 5 mm or less, and the cut pieces (about 5 mg) were enveloped in an aluminum pan, and the aluminum pan including the sample pieces was heated from a room temperature to 200° C. at an elevation rate of 10° C./minute, referring to an empty aluminum pan of the same type, to determine an endothermic peak. The temperature of the top of the melting peaks which appeared on the lowest temperature side of the obtained curve was defined as a melting point.

(Measurement of Raman Scattering Spectrum)

The Raman scattering spectrum was measured as follows. As a Raman spectrometer, System 1000 manufactured by Renishaw was used. As a light source, helium neon laser (wavelength: 633 nm) was used, and a filament was placed with its axis in parallel to a polarization direction for measurement. A multifilament was slit into monofilaments, and one of the monofilaments was stuck on a paper board having a rectangular hole (50 mm (vertical)×10 mm (lateral)) so that the center longer axis of the hole could be aligned with the axis of the filament, and both ends of the filament were adhered with an epoxy adhesive (Araldite) and was then left to stand for 2 or more days. After that, the filament on the paper board was attached to a jig controllable in length with a micrometer, and the paper board having the filament thereon was carefully cut off. Then, a predetermined load was applied to the filament, and the filament under the load was placed on the stage of the microscope of the Raman scattering apparatus so as to measure the Raman spectrum thereof. In this measurement, a stress acting on the filament and the distortion of the filament were simultaneously measured. In the Raman measurement, data of the filament were collected in the static mode, provided that the resolution per one pixel was set at not larger than 1 $cm^{-1}$ within a measuring range of 850 $cm^{-1}$ to 1,350 $cm^{-1}$. A peak used for the analysis was taken from a band of 1,128 $cm^{-1}$ attributed to the symmetric stretching mode of a C—C backbone bond. To correctly determine the center of gravity of the band and the width of the line (the standard deviation of a profile having its center on the center of gravity of the band, and a square root of secondary moment), the profile was approximated as a synthesis of two Gaussian functions, so that the curves could be successfully fitted to each other. It was found that, when the filament was distorted, the peaks of the two Gaussian functions did not coincide with each other, and that the distance between each of the peaks became longer. According to the present invention, the position of the peak of the band was not taken as a top of the peak profile, and the center of gravity of two Gaussian peaks was defined as the position of the peak of the band. This definition was represented by the equation 1 (a position of the center of gravity, <x>). A graph was made by plotting the positions of center of gravity of the band <x> and the stress applied to the filament. The gradient of the approximated curve passing through the origin which was obtained by the method of least squares of the resultant plots was defined as a stress Raman shift factor.

$$\langle x\rangle = \int x f(x)dx / \int f(x)dx$$

$$f(x) = f1(x-a) + f2(x-b)$$

wherein fi represents a Gaussian function.

[Evaluation Methods for Crystal Size and Orientation]

The crystal size and the orientation of crystals in the filament were measured by the X-ray diffraction method. As the X-ray source, a large-scale radiation plant, SPring8, was used together with BL24XU hatch. The energy of X-ray used was 10 keV (λ=1.2389 angstrom). X-rays taken out through an undulator were changed into monochromatic light through a monochromator (the (111) plane of a silicon crystal) and then was converged at a sample position, using a phase zone plate. The size of the focus was adjusted to a diameter of not larger than 3 μm in both of vertical and lateral directions. The filament as a sample was placed on a XYZ stage with its axis directed horizontally. The intensity of Thomson scattering was measured with a separately attached Thomson scattering detector, while the stage being finely adjusted, and the point at which the intensity was the highest was determined as the center of the filament. The intensity of X-rays is very high, and therefore, the sample is damaged if the exposure time of the sample is too long. For this reason, the exposure time in the X-ray diffraction measurement was set at not longer than 2 minutes. Under the above-described conditions, the filament was irradiated with a beam, from its skin portion to its core portion and at 5 or more sites thereof spaced at substantially regular intervals, and the X-ray diffraction figures obtained from the respective sites of the filament were measured. The X-ray diffraction figures were recorded using an imaging plate manufactured by Fuji. The recorded image data were read using a microminography manufactured by Fiji. The recorded image data were transferred to a personal computer to select the data relative to the equator direction and the azimuth direction, and then, the width between the lines was evaluated. The crystal size (ACS) was calculated from the half band width β of the diffraction profile in the equator direction, using the following equation [1]. The identification of the diffraction peak was made according to the method of Bunn et al. (Trans Faraday Soc., 35, 482 (1939)). As the crystal size, an average of the found values obtained by the measurement at 5 or more points of the filament was used. CV was calculated by the following equation.

$$CV = \text{the standard deviation of the crystal size/the average of the crystal sizes} \times 100$$

$$ACS = 0.9\lambda/\beta \cos\theta \qquad \text{[Equation 1]}$$

Herein, λ represents the wavelength of X-ray used, and θ represents the diffraction angle.

As the orientation angle OA, a half band width of a profile found by scanning each of the obtained two-dimensional diffraction figure along the azimuth direction was used, and an average of the found half band widths was used as the orientation angle. CV was calculated by the following equation:

$$CV = \text{a standard deviation of the orientation angle/the average of the orientation angles} \times 100$$

[Evaluation Method for a Crystal Size of Monoclinic Crystal]

The crystal size was measured by the X-ray diffraction method. The apparatus used for the measurement was Rint 2500 manufactured by Rigaku. As the X-ray source, copper anticathode was used. The operation output was 40 kV and 200 mA. A collimator with a slit of 0.5 mm was used. A filament was attached to the sample table, and the counter was scanned in the equator direction and the meridian direction so as to measure the intensity distribution of the X-ray diffraction of the filament. As both the vertical and lateral limits of the light-receiving slit, 1/20 was selected. The crystal size (ACS) was calculated from the half band width β of the diffraction profile, using the Scherrer's equation [Equation 2].

$$ACS = 0.9\lambda/\beta 0 \cos\theta, \text{ provided that}$$

$$\beta 0 = (\beta 2 - \beta s)0.5. \qquad \text{[Equation 2]}$$

In this equation, λ represents the wavelength of the X-ray beam used; 2θ represents the diffraction angle; and βs represents the half band width of the X-ray beam measured using a standard sample.

The size of the monoclinic crystal was determined from the width between the lines at a diffraction point derived from the (010) plane of the monoclinic crystal, and ACS was calculated using the Scherrer's equation. The diffraction peak was identified according to the method of Seto et al. (Jap. J. Appl. Phys., 7, 31 (1968)). The orthorhombic crystal size ratio was determined by dividing the crystal size derived from the (200) diffraction by the crystal size derived from the (020) diffraction.

EXAMPLES 1 to 3

A slurry-like mixture was prepared by mixing a ultra-high molecular weight polyethylene having a limiting viscosity of 21.0 dl/g, and decahydronaphthalene in the weight ratio 8:92. This mixture was dissolved with a twin-screwed extruder equipped with a mixer and a conveyer, to obtain a transparent and homogenous solution. This solution was extruded from an orifice with a diameter of 0.8 mm, having 30 holes circularly arranged, at a rate of 1.8 g/minute. The extruded solutions were allowed to pass through a cylindrical tube filled with continuously flowing water, via an air gap with a length of 10 mm, so as to evenly cool them. The resultant gel-like filaments were pulled at a rate of 60 m/minute, without the removal of the solvent. In this connection, the cooling rate of the gel-like filaments was 9,669° C./second, and the accumulated speed difference was 5 m/minute. Then, the gel-like filaments were drawn to be three times longer in a heated oven under a nitrogen atmosphere, without winding them up. Then, the drawn filaments were wound up. Next, the filaments were drawn at 149° C. at a variously changed drawing multiplying factor up to the maximum 6.5. The physical properties of the resultant polyethylene filaments are shown in Table 1.

EXAMPLES 4 and 5

A slurry-like mixture of a ultra-high molecular weight polyethylene having a limiting viscosity of 19.6 dl/g (10 wt. %) and decahydronaphthalene (90 wt. %) was dispersed and dissolved with a screw type kneader set at 230° C., and the resultant solution was fed to a spinneret with a diameter of 0.6 mm, which had 400 holes and was set at 177° C., at an extrusion rate of 1.2 g/min./hole, using a light pump. Polyethylene filaments were obtained in the same manners as in Example 1, except that a nitrogen gas was evenly applied to the respective extruded filament-like solutions at a rate of 0.1 m/second, using collar-like quench devices independently provided just below the respective nozzles, while paying careful attentions to the rectificated flow of the nitrogen gas, so that a minute amount of decalin was evaporated from the surfaces of the resulting filaments, and that the above extruded filament-like solutions were allowed to pass through an air gap under a nitrogen atmosphere. In this regard, the multiplying factor for the drawing in the second step was 4.5 or 6.0. The temperature of the nitrogen gas used for quenching was controlled at 178° C. The air gap was not controlled in temperature. The values of the physical properties of the resultant filaments are shown in Table 1. The filaments were found to be very excellent in uniformity and to have high strength.

COMPARATIVE EXAMPLE 1

A slurry-like mixture of a ultra-high molecular weight polyethylene having a limiting viscosity of 19.6 dl/g (10 wt. %) and decahydronaphthalene (90 wt. %) was dispersed and dissolved with a screw type kneader set at 230° C., and the resultant solution was fed to a spinneret with a diameter of 0.6 mm, which had 400 holes and was set at 175° C., at an extrusion rate of 1.6 g/min./hole, using a light pump. A nitrogen gas controlled at 100° C. was applied to the extruded filament-like solutions as evenly as possible, at a high velocity of 1.2 m/second, from a slit-shaped gas-feeding orifice provided just below nozzles, while paying careful attentions to the rectificated flow of the nitrogen gas, so as to aggressively evaporate decalin from the surfaces of the resultant filaments. The residual decalin on the surfaces of the filaments was further evaporated by a nitrogen flow controlled at 115° C., and the resultant filaments were pulled up with a Nelson-like roller at a rate of 80 m/minute installed on the side of the downstream from the nozzles. In this regard, the length of the quench section was 1.0 m; the cooling rate of the filaments was 100° C./second; and the accumulated speed difference was 80 m/minute. Subsequentially, the resultant filaments were drawn to be 4.0 times longer, under a heated oven at 125° C., and were sequentially drawn to be 4.1 times longer in a heated oven at 149° C. Uniform filaments could be obtained without breaking. The physical properties of the filaments are shown in Table 1.

COMPARATIVE EXAMPLE 2

Drawn filaments were obtained in the same manners as in Example, except that a nitrogen gas flow controlled at 50° C. was applied to the extruded filament-like solutions as evenly as possible and at a velocity of 0.5 m/second, from a position just below the orifice, while paying careful attentions to the rectificated flow of the Nitrogen gas, to thereby obtain gel-like filaments. The cooling rate of the filaments was 208° C./second, and the accumulated speed difference was 80 m/minute.

COMPARATIVE EXAMPLE 3

A slurry-like mixture of a ultra-high molecular weight polymer comprising a polymer (C) as a main component and having a limiting viscosity of 10.6 (15 wt. %) and paraffin wax (85 wt. %) was dispersed and melted with a screw type kneader set at 230° C., and the resulting solution was fed to spinneret with a diameter of 1.0 mm, which had 400 holes and was set at 190° C., at an extrusion rate of 2.0 g/minute/hole, using a light pump. The resultant filament-like solutions were allowed to pass through an air gap with a length of 30 mm, and were then immersed in a spinning bath filled with n-hexane at 15° C. After the immersion, the filaments were pulled up with a Nelson-like roller at a rate of 50 m/minute. The cooling rate of the filaments was 4,861° C./second, and the accumulated speed difference was 50 m/minute. Sequentially, the filaments were drawn at a multiplying factor of 3.0 under a heated oven of 125° C., and were further drawn at a multiplying factor of 3.0 in a heated oven at 149° C., and were once more drawn at a multiplying factor of 1.5. Uniform filaments could be obtained without breaking. The physical properties of the filaments are shown in Table 1.

COMPARATIVE EXAMPLE 4

Wound filaments which were obtained under the same conditions as in Comparative Example 1, before a drawing step, were immersed in ethanol for 3 days to remove the residual decalin from the filaments. After that, the filaments were dried in an air for 2 days to obtain xerogel filaments. The xerogel filaments were drawn at a multiplying factor of 4.0 in a heated oven at 125° C., and were sequentially further drawn at a multiplying factor of 4.3 in a heated oven at 155° C. Uniform filaments could be obtained without breaking.

TABLE 1

(Part 1)

| | | Ex. 1 | Ex. 2 | Ex. 3 | Ex. 4 | Ex. 5 |
|---|---|---|---|---|---|---|
| Total multiplying factor | | 16.0 | 17.5 | 19.5 | 13.5 | 18.0 |
| Fineness | dTex | 45 | 41 | 37 | 591 | 440 |
| Fineness/mono-filament | dTex | 1.5 | 1.4 | 1.2 | 1.5 | 1.1 |
| Strength | CN/dTex | 38 | 42 | 49 | 43 | 47 |
| Elongation at break | % | 4.2 | 4.1 | 4.0 | 4.2 | 4.2 |
| Stress Raman shift factor | | −3.5 | −3.4 | −3.3 | −3.4 | −3.3 |
| Knot strength retention/mono-filament | % | 47.0 | 50.0 | 54.0 | 46.0 | 54.0 |
| Variation in strengths of monofilaments | CV % | 21 | 22 | 23 | 15 | 16 |
| Melting point | ° C. | 146.2 | 146.6 | 146.6 | 146.2 | 146.3 |
| Crystal size | nm | 22 | 25 | 27 | 30 | 19 |
| Orientation angle | ° | 2.1 | 1.6 | 1.1 | 3.1 | 1.9 |
| Crystal size CV | CV % | 9.0 | 8.4 | 5.3 | 5.2 | 3.1 |
| Orientation angle CV | CV % | 9.1 | 8.2 | 5.1 | 5.5 | 2.2 |
| Monoclinic crystal size | nm | 5.9 | 7.1 | 8.3 | 3.2 | 4.1 |
| Ratio of crystal sizes | | 0.85 | 0.92 | 1.01 | 0.97 | 1.12 |

TABLE 1

(Part 2)

| | | C. Ex. 1 | C. Ex. 2 | C. Ex. 3 | C. Ex. 4 |
|---|---|---|---|---|---|
| Total multiplying factor | | 16.4 | 16.4 | 13.5 | 17.2 |
| Fineness | dTex | 490 | 490 | 1,780 | 472 |
| Fineness/mono-filament | dTex | 1.2 | 1.2 | 4.4 | 1.1 |
| Strength | CN/dTex | 29.2 | 30.1 | 28 | 27.3 |
| Elongation at break | % | 3.4 | 3.4 | 3.3 | 3.1 |
| Stress Raman shift factor | | −5.3 | −5.1 | −5.5 | −5.7 |
| Knot strength retention/mono-filament | % | 43.0 | 44.0 | 38.0 | 41.0 |
| Variation in strengths of monofilaments | CV % | 31 | 28 | 40 | 22 |
| Melting point | ° C. | 145.6 | 146.0 | 148.0 | 149.1 |
| Crystal size | nm | 16 | 15 | 13 | 34 |
| Orientation angle | ° | 4.3 | 4.7 | 4.5 | 0.7 |
| Crystal size CV | CV % | 11.0 | 12.2 | 13.6 | 12.4 |
| Orientation angle CV | CV % | 11.4 | 13.2 | 12.9 | 10.9 |
| Monoclinic crystal size | nm | 13.1 | 12.2 | 13.9 | 14.2 |
| Ratio of crystal sizes | | 0.67 | 0.73 | 0.76 | 1.31 |

INDUSTRIAL APPLICABILITY

The high strength polyethylene filaments according to the present invention have high strengths, high elastic modulus and uniform internal structures. Therefore, they are applicable in a wide range of industrial fields such as high performance textiles for sportswears, safety outfits (e.g., bullet-proof/protective clothing, protective grooves, etc.) and the like, rope products (e.g., tugboat ropes, mooring ropes, yacht ropes, ropes for construction, etc.), fishing lines, braided ropes (e.g., blind cables, etc.), net products (e.g., fisheries nets, ball-protective nets, etc.), reinforcing materials or non-woven cloths for chemical filters, buttery separators, etc., canvas for tents, etc., and reinforcing fibers for composites which are used in sports goods (e.g., helmets, skis, etc.), speaker cones, prepregs, concrete, etc.

The invention claimed is:

1. A high strength polyethylene multifilament, wherein said multifilament has a stress Raman shift factor of not smaller than $-5.0\ cm^{-1}/(cN/dTex)$; wherein said multifilament has an average strength of not lower than 38 cN/dTex; wherein a knot strength retention of monofilaments constituting the high strength multifilament is not lower than 40%; and wherein said multifilament has an elongation at break of from 2.5% inclusive to 6.0% inclusive.

2. A high strength polyethylene multifilament, wherein said multifilament has a crystal size of monoclinic crystal of not larger than 9 nm; wherein said multifilament has an average strength of not lower than 38 cN/dTex; and wherein a knot strength retention of monofilaments constituting the high strength multifilament is not lower than 40%.

3. The high strength polyethylene multifilament according to claim 1 or claim 2, wherein CV which indicates a variation in the strengths of monofilaments constituting the high strength multifilament is not higher than 25%.

4. The high strength polyethylene multifilament according to claim 1 or claim 2, wherein said multifilament has an elongation at break of from 3.5% inclusive to 5.0% inclusive.

5. The high strength polyethylene multifilament according to claim 1 or claim 2, wherein each of filaments constituting the multifilament has a fineness of not higher than 10 dTex.

6. The high strength polyethylene multifilament according to claim 1 or claim 2, wherein the melting point of filaments is not lower than 145° C.

7. The high strength polyethylene multifilament according to claim 2, wherein said multifilament has a ratio of the crystal sizes derived from the (200) and (020) diffractions of an orthorhombic crystal of from 0.8 inclusive to 1.2 inclusive.

* * * * *

UNITED STATES PATENT AND TRADEMARK OFFICE

CERTIFICATE OF CORRECTION

PATENT NO. : 7,811,673 B2
APPLICATION NO. : 10/582624
DATED : October 12, 2010
INVENTOR(S) : Godo Sakamoto et al.

It is certified that error appears in the above-identified patent and that said Letters Patent is hereby corrected as shown below:

Title Page, Column 1 under Item (22) PCT FILED, the International Filing Date of "Mar. 12, 2004" should be changed to --Dec. 3, 2004--.

Signed and Sealed this
Twenty-eighth Day of December, 2010

David J. Kappos

David J. Kappos
*Director of the United States Patent and Trademark Office*